US010989131B2

(12) United States Patent
Gargiso et al.

(10) Patent No.: US 10,989,131 B2
(45) Date of Patent: Apr. 27, 2021

(54) METHOD AND DEVICE FOR DETERMINING ENERGIZATION DATA FOR AN ACTUATOR OF AN INJECTION VALVE OF A MOTOR VEHICLE

(71) Applicant: Continental Automotive GmbH, Hannover (DE)

(72) Inventors: Tany Gargiso, Donaustauf (DE); Michael Kausche, Regensburg (DE); Hans-Jörg Wiehoff, Regensburg (DE)

(73) Assignee: VITESCO TECHNOLOGIES GMBH, Hanover (DE)

( * ) Notice: Subject to any disclaimer, the term of this patent is extended or adjusted under 35 U.S.C. 154(b) by 111 days.

(21) Appl. No.: 16/308,413

(22) PCT Filed: Jun. 8, 2017

(86) PCT No.: PCT/EP2017/064028
§ 371 (c)(1),
(2) Date: Dec. 7, 2018

(87) PCT Pub. No.: WO2017/216041
PCT Pub. Date: Dec. 21, 2017

(65) Prior Publication Data

US 2019/0136781 A1 May 9, 2019

(30) Foreign Application Priority Data

Jun. 13, 2016 (DE) ..... 10 2016 210 449.7

(51) Int. Cl.
*F02D 41/20* (2006.01)
*F02D 41/40* (2006.01)
*F02D 41/14* (2006.01)

(52) U.S. Cl.
CPC ..... *F02D 41/2096* (2013.01); *F02D 41/20* (2013.01); *F02D 41/401* (2013.01);
(Continued)

(58) Field of Classification Search
CPC ..... F02D 2041/1433; F02D 2041/2027; F02D 2041/2041; F02D 2041/2068; F02D 41/20; F02D 41/2096; F02D 41/401
See application file for complete search history.

(56) References Cited

U.S. PATENT DOCUMENTS 6,459,244 B1 10/2002 Hoffmann et al. ..... 320/166
8,074,626 B2 12/2011 Fukushima ..... 123/494
(Continued)

FOREIGN PATENT DOCUMENTS

DE 103 11 141 A1 9/2004 ..... F02D 41/20
DE 10 2008 026 799 A1 12/2009 ..... H01H 33/662
(Continued)

OTHER PUBLICATIONS

Korean Notice of Allowance, Application No. 2020010505087, 3 pages, dated Feb. 11, 2020.
(Continued)

*Primary Examiner* — Carl C Staubach
(74) *Attorney, Agent, or Firm* — Slayden Grubert Beard PLLC

(57) ABSTRACT

Various embodiments includes a method for determining energization data for an actuator of an injection valve of a motor vehicle comprising: receiving input data at a control unit; and determining the energization data based on the received input data into account with the control unit. Determining the energization data includes using a polynomial regression model.

15 Claims, 6 Drawing Sheets

(52) U.S. Cl.
CPC ..... *F02D 2041/1433* (2013.01); *F02D 2041/2027* (2013.01); *F02D 2041/2041* (2013.01); *F02D 2041/2068* (2013.01)

(56) References Cited

U.S. PATENT DOCUMENTS

| | | | | |
|---|---|---|---|---|
| 2003/0083801 | A1* | 5/2003 | Mollin | F02D 41/34 701/104 |
| 2003/0165039 | A1* | 9/2003 | Moran | F02D 41/20 361/160 |
| 2004/0057189 | A1* | 3/2004 | Cheever, Jr. | F02D 41/2096 361/160 |
| 2004/0237940 | A1 | 12/2004 | Joos et al. | 123/478 |
| 2009/0326788 | A1* | 12/2009 | Yuasa | F02D 41/3809 701/104 |
| 2012/0095668 | A1* | 4/2012 | Landsmann | F02D 35/028 701/103 |
| 2012/0185147 | A1 | 7/2012 | Beer | 701/102 |
| 2014/0058645 | A1 | 2/2014 | Stroh et al. | 701/103 |
| 2015/0013647 | A1* | 1/2015 | Zhang | F02M 57/005 123/478 |
| 2015/0233318 | A1 | 8/2015 | Nieddu et al. | 701/104 |
| 2019/0331046 | A1* | 10/2019 | Katzenburger | F02D 41/2438 |

FOREIGN PATENT DOCUMENTS

| | | | | |
|---|---|---|---|---|
| DE | 102008029799 | A1 | 12/2009 | F02D 41/20 |
| DE | 10 2008 042 146 | A1 | 3/2010 | H02N 2/06 |
| DE | 10 2009 043 124 | B4 | 6/2011 | F02D 41/00 |
| DE | 10 2009 059 931 | A1 | 6/2011 | G06F 17/10 |
| DE | 10 2011 113 605 | A1 | 4/2012 | F02D 41/30 |
| EP | 2386021 | A1 | 10/2012 | F02D 41/20 |
| GB | 2480076 | A | 11/2011 | F02D 41/20 |
| JP | 2009041451 | A | 2/2009 | F02D 41/04 |
| KR | 20020032525 | A | 5/2002 | F02D 41/20 |
| WO | 2010/066574 | A1 | 6/2010 | F02D 41/20 |
| WO | 2017/216041 | A1 | 12/2017 | F02D 41/14 |

OTHER PUBLICATIONS

Korean Office Action, Application No. 2018-7035985, 8 pages, dated Oct. 18, 2019.

German Office Action, Application No. 10 2016 210 449.7, 5 pages, dated Dec. 30, 2016.

International Search Report, Application No. PCT/EP2017/064028, 17 pages, dated Oct. 6, 2017.

* cited by examiner

METHOD AND DEVICE FOR DETERMINING ENERGIZATION DATA FOR AN ACTUATOR OF AN INJECTION VALVE OF A MOTOR VEHICLE

CROSS-REFERENCE TO RELATED APPLICATIONS

This application is a U.S. National Stage Application of International Application No. PCT/EP2017/064028 filed Jun. 8, 2017, which designates the United States of America, and claims priority to DE Application No. 10 2016 210 449.7 filed Jun. 13, 2016, the contents of which are hereby incorporated by reference in their entirety.

TECHNICAL FIELD

The present disclosure may be embodied in a method and/or a device for determining energization data for an actuator of an injection valve of a motor vehicle. The actuator may be an electromechanical or electromagnetic transducer, for example a piezo transducer or a piezo actuator.

BACKGROUND

An electromechanical transducer may be used in injection valves for internal combustion engines in which the nozzle needle is activated directly or indirectly by a piezo transducer. Very stringent requirements in terms of the accuracy and robustness of the injection quantity apply to these injection valves under all operating conditions and over the entire service life of the respective motor vehicle. The energization time for such an electromechanical transducer is usually defined as a function of the operating point and is dependent on the current strength, the stroke which is to be made available, the respectively present temperature conditions and the force ratios before and during the activation of the electromechanical transducer.

These above-mentioned influencing variables cannot be measured directly by means of the respective control unit. Therefore, in contemporary applications, characteristic diagrams are calibrated in the respective control unit to predefine the energization time as a function of the operating point, wherein the respectively required influencing variables are determined empirically. The basic values stored in the characteristic diagrams can be corrected during the operation of the respective motor vehicle, by using a closed-loop control system.

However, empirically determining the required influencing variables in order to produce the specified characteristic diagrams entails a large amount of expenditure. Furthermore, the correction of the basic values stored in the characteristic diagrams which is carried out during the operation of the respective motor vehicle, using a closed-loop control system, is comparatively slow, with the result that it is often not possible to ensure that the stringent requirements in respect of the accuracy of the fuel injection quantity are satisfied.

SUMMARY

The teachings of the present disclosure may be used to improve the determination of the energization data of an actuator of an injection valve of a motor vehicle. As an example, some embodiments may include a method for determining energization data for an actuator of an injection valve of a motor vehicle, in which a control unit is supplied with input data and the control unit determines the energization data while taking the input data into account, characterized in that the control unit (1) determines the energization data (BD, SS) by using a polynomial regression model (4).

In some embodiments, the control unit (1) determines the energization data as a function of the operating point.

In some embodiments, the control unit (1) determines an energization period (BD).

In some embodiments, the control unit (1) determines a current profile (SS).

In some embodiments, the control unit (1) determines current strength values at predefined times of the energization period (BD).

In some embodiments, information about a desired piezo voltage is supplied as input data to the polynomial regression model (4).

In some embodiments, information about a desired piezo charge is supplied as input data to the polynomial regression model (4).

In some embodiments, information about a desired behavior of the actuator is supplied as input data to the polynomial regression model (4).

In some embodiments, information about a desired oscillation behavior of the actuator is supplied as input data to the polynomial regression model (4).

In some embodiments, temperature information is supplied as input data to the polynomial regression model (4).

In some embodiments, information about one or more individual parameters of the actuator is supplied as input data to the polynomial regression model (4).

In some embodiments, information about a maximum available energization time window is supplied as input data to the polynomial regression model (4).

In some embodiments, the actuator (P) is an electromechanical or an electromagnetic transducer.

In some embodiments, the actuator is a piezo actuator.

As another example, some embodiments include a device for determining energization data for an actuator of an injection valve of a motor vehicle, which device has a control unit which can be supplied with input data and which is designed to determine the energization data while taking the input data into account, characterized in that the control unit is also designed to determine the energization data (BD, SS) by using a polynomial regression model (4).

BRIEF DESCRIPTION OF THE DRAWINGS

Further characteristics of the teachings herein emerge from the exemplary explanation thereof below on the basis of the figures. In the figures.

DETAILED DESCRIPTION

Example methods incorporating teachings of the present disclosure may simplify the determination of the energization data compared to empirical determination of the energization time. Furthermore, the methods may provide a precise determination of the energization data of the actuator by virtue of the consideration of the characteristic of the respectively used output stage in conjunction with the characteristic of the actuator. This precise determination of the energization data makes it possible to ensure that the existing stringent requirements in respect of the accuracy of the fuel injection quantity are satisfied. Furthermore, existing controllers are relieved, which achieves greater system stability.

Figure 1:
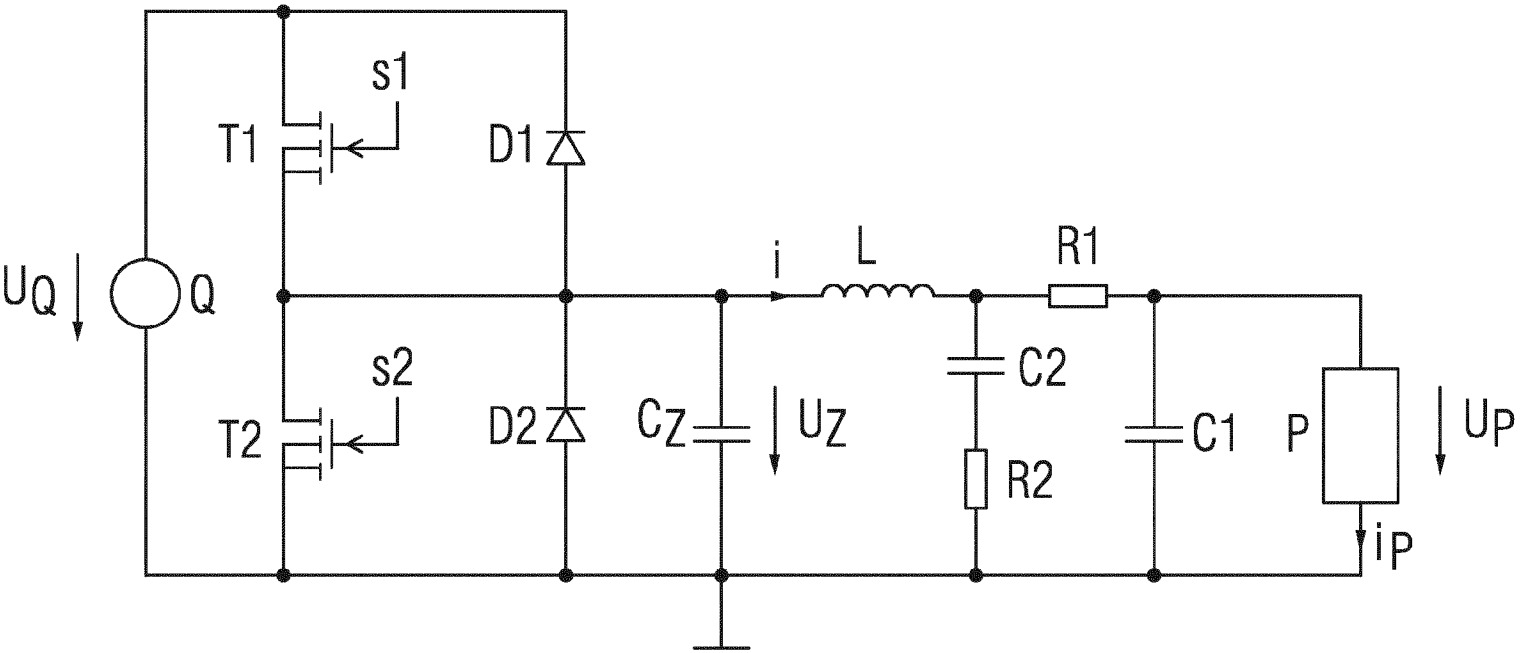
FIG. 1 shows an illustration of a current-controlled piezo output stage incorporating teachings of the present disclosure.

FIG. 1 shows an illustration of a current-controlled piezo output stage which can be used in a method for determining energization data of an injection valve of a motor vehicle. This piezo output stage has a 2-quadrant buck-boost converter, which includes a buck converter T1, D2 and a boost converter T2, D1. The transistor T1 of the buck converter, which is implemented as a field effect transistor, is actuated by a control signal s1. The transistor T2 of the boost converter, which is likewise implemented as a field effect transistor, is actuated by a control signal s2. The control signals s1 and s2 are made available by a control unit, as is explained in conjunction with FIG. 6.

In some embodiments, the connecting point between the diodes D1 and D2 of the buck-boost converter is connected to a terminal of an intermediate capacitor $C_Z$, the other terminal of which is connected to ground. A voltage $U_Z$, referred to below as the intermediate voltage, is present at this intermediate capacitor $C_Z$. Furthermore, the connecting point between the diodes D1 and D2 may be connected to a terminal of a coil L, which is the main inductor of the piezo output stage. The other terminal of this main inductor is connected to the piezo actuator P via a low pass filter R1/C1. A current i flows through the coil L, and a current $i_P$ flows through the piezo actuator. A voltage $U_P$, referred to below as the piezo voltage, drops across the piezo actuator.

The topology of the illustrated piezo output stage can be described in simplified form by an anti-parallel connection of the buck converter and of the boost converter. The operating modes of this piezo output stage are distinguished by the fact that the coil current i of the main inductor L is higher than zero in the buck mode and lower than zero in the boost mode. In this context, there is no overlap between these two operating modes in the piezo output stage. Therefore, it is sufficient, as illustrated in FIG. 1, to use just one coil as a main inductor.

In the buck operating mode, the piezo actuator P is charged. During this charging, the switch T1 is alternately switched on and off by means of pulse width modulation. During the switch-on time of T1, the diode D2 initially acts in a blocking fashion, and the current flowing through the coil L rises. In this case, energy is dissipated in the coil which serves as a magnetic accumulator. In this case, the current rises evenly according to the relationship specified in the following equation (1):

$$i=1/L\int u dt \quad (1).$$

At the start of the charging process, the voltage which is present at the coil corresponds approximately to the value of the direct voltage $U_Q$ which is made available by the voltage source Q.

The differential current of the main inductor L in the switch-on phase of T1 can be described by the following equation (2):

$$di/dt=(U_Q-U_P)/L \quad (2).$$

During the switch-off phase of T1, the energy which is stored in the inductor is reduced. In this context, the diode D2 acts in a free-wheeling fashion, with the result that the load current can flow on. Since the output voltage is now present at the coil, the polarity of the coil voltage changes. The output current decreases continuously here. In this case, the piezo actuator P is fed by the coil. The following relationship applies for a differential consideration of the current at the main inductor during the switch-off phase:

$$di/dt=(-U_P)/L \quad (3).$$

The discharging of the piezo actuator P is carried out using the boost converter, wherein the piezo actuator P acts as a voltage source. During the discharging of the piezo actuator, the coil current i is lower than zero. Just like the buck converter in the charging phase, the boost converter is operated with pulse width modulation in the discharging phase. During the switch-on phase of T2, a freewheeling operation firstly occurs. This means that the current flows through the switch T2, with the result that the current flowing through the coil rises. In the switch-off phase of T2, feedback takes place into the voltage source Q via both diodes D1 and D2. In this context, the current flows from the consumer, i.e. the piezo actuator P, back into the source Q via the coil L. The following relationship applies to the differential current:

$$di/dt=U_P/L \quad (4).$$

The following relationship applies to the differential current during the switch-off phase of T2:

$$di/dt=(U_P-U_Q)/L \quad (5).$$

Owing to the method of functioning of the 2-quadrant converter, the power conversion of the piezo actuator is reduced during the discharging phase as the level of the piezo voltage drops. This results in a significantly longer discharging time being set, with the result that the piezo actuator possibly does not discharge completely. In order to avoid this, a current-controlled resistor (not shown) is connected in parallel with the piezo actuator P during the discharging. The pulse width modulation mentioned above results from the use of comparator thresholds, as illustrated in FIG. 2.

Figure 2:
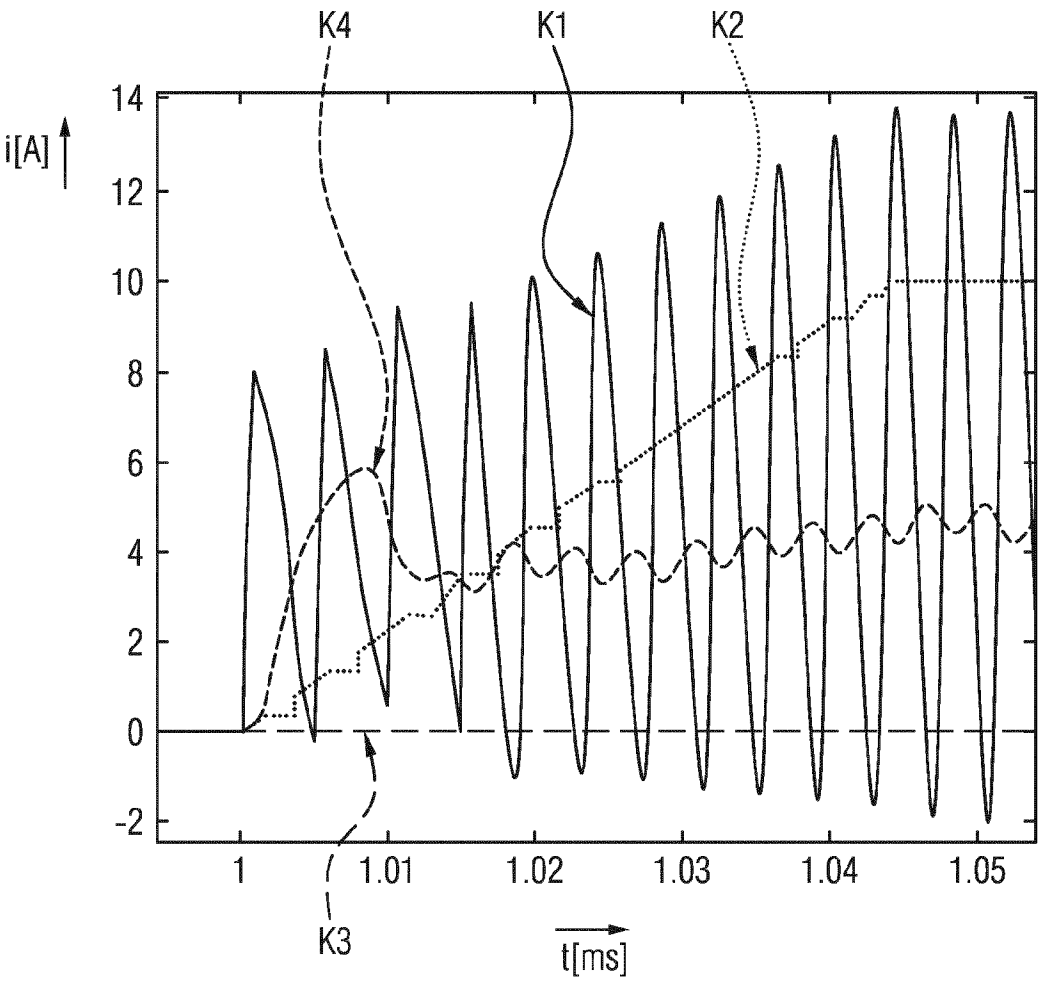
FIG. 2 shows a diagram illustrating the behavior of the comparator during the charging process incorporating teachings of the present disclosure.

In this FIG. 2, the current is plotted at the top in amperes and the time is plotted on the right in milliseconds. Curve K1 illustrates the actual current flowing through the coil L, curve K2 illustrates a desired setpoint current which corresponds to an upper comparator threshold, curve K3 corresponds to the zero value of the current which forms a lower comparator threshold, and curve K4 illustrates the actual current flowing through the piezo actuator P.

The desired setpoint current of the coil L is compared with the associated actual current by means of a comparator. If, for example during the charging of the piezo actuator, the actual current exceeds the predefined setpoint current after the switching on of the switch T1, the comparator output switches off the switch T1, with the result that the actual current decreases again. If the decreasing actual current reaches the zero crossover, T1 is switched on again. These processes are repeated until a desired predefined charging time is reached. The pulse width modulation which takes place during the discharging process is performed in an equivalent fashion.

In some embodiments, other specific modes can also be used for the pulse width modulation. Another specific mode consists, for example, in using a controlled pulse operation of the first pulses on the basis of the minimum switching time behavior of the switches which are used. It is possible to derive from the above-described use of a dynamic pulse width modulation that the current gradient has a significant influence on the switching behavior of the switches T1 and T2 which are used. As is apparent from the equation (2) specified above, the rising function of the current is influenced mainly by the voltage difference between $U_Q$ and the piezo voltage $U_P$.

Figure 3:
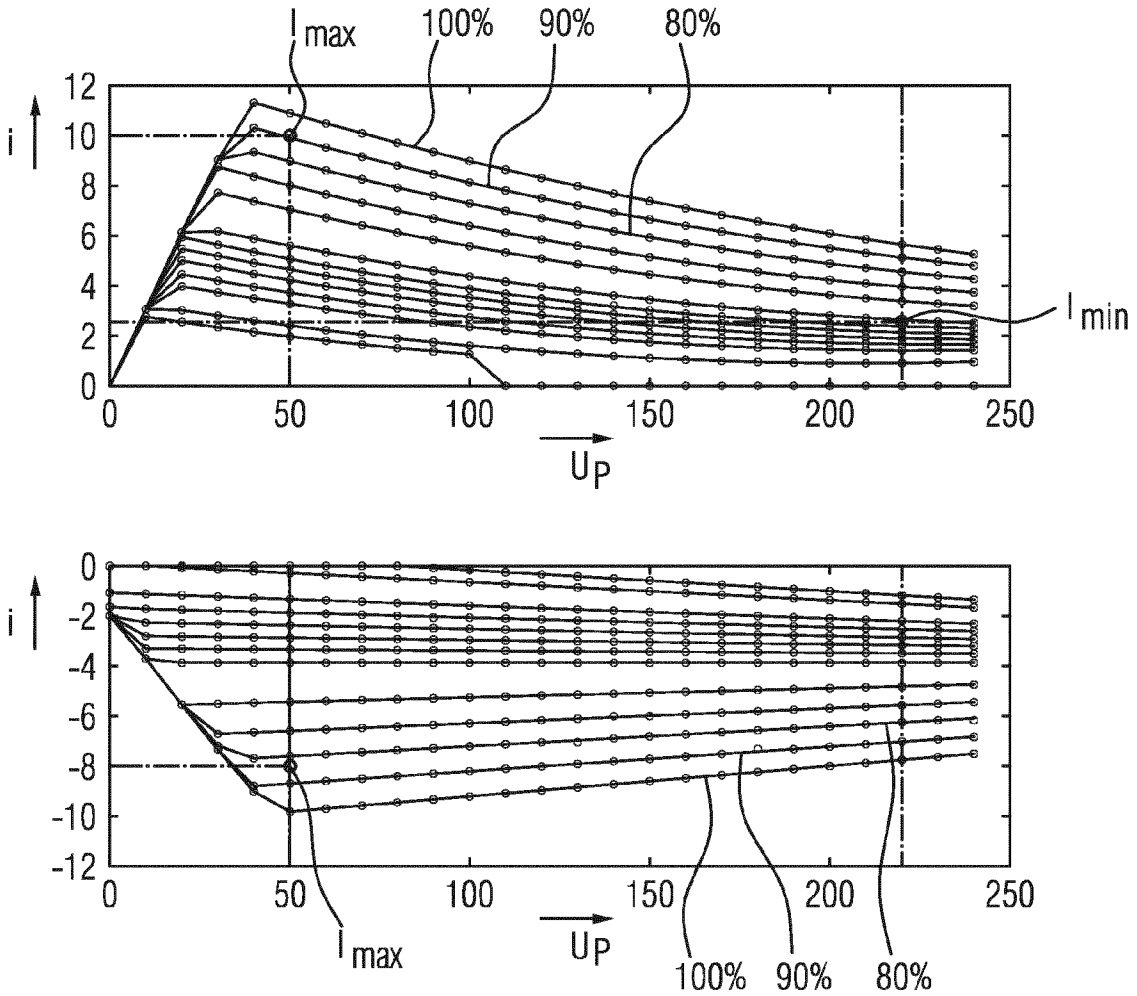
FIG. 3 shows diagrams illustrating current profiles for the charging process and the discharging process of the piezo actuator as a function of the piezo voltage incorporating teachings of the present disclosure.

If the profiles of the piezo voltage $U_P$ and of the piezo current $i_P$ are transferred to a diagram for a current setpoint value, a voltage/current characteristic curve is obtained which characterizes the behavior of the output stage. This is illustrated below on the basis of FIG. 3. Said FIG. 3 shows the current profiles for the charging process (FIG. 3*a*) and the discharging process (FIG. 3*b*) of the piezo actuator in conjunction with the piezo output stage. The resulting absolute currents are plotted against the piezo voltage at which they are present. The individual lines correspond here to a specific setpoint current strength which is specified as a percentage. The 100% curve, which in FIG. 3*a* corresponds to the top line, represents the fastest possible charging process in this context. It is apparent that as the voltage rises relatively low values of the absolute currents are available if the setpoint current prescription is kept constant. This results in a slowed-down charging or discharging process. Furthermore, it is apparent that at low voltages (<50V) it is not possible to reach certain current ranges. The cause of this is limitation of the permissible current gradient. The curves which are illustrated below the top line in FIG. 3*a* are the 90% curve, the 80% curve, the 70% curve etc.

The current profiles shown in FIG. 3 permit a regression in the form of a two-dimensional polynomial with coefficients a to f. The range of low voltages is ignored here, since it is not relevant to the application.

$$I[A]=a\cdot I[\%]^2+b\cdot I[\%]+c\cdot U[V]^2+d\cdot U[V]+e\cdot I[\%]\cdot U[V]+f \quad (6)$$

In this context:

I[A] denotes the piezo absolute current strength,

I[%] denotes the piezo setpoint current strength,

U[V] denotes the piezo voltage.

Costly storage and reading out of the current values for the iteration process described below can be avoided. The above-described model-like description of the output stage is now used in a control unit in order to determine the energization data of the piezo actuator during the charging and the discharging. In this context, iteration is carried out starting from a setpoint value for the steady-state final voltage or discharging and a predefined setpoint current configuration. In this context, chronological discretization of the charging process and/or discharging process takes place. For each time step, the absolute current, the associated discrete charge quantity and the piezo voltage which is set are determined. The basis for this is the polynomial regression model described above. The number of necessary time steps which reflect the desired setpoint charge state/setpoint voltage state corresponds to the charging time and/or discharging time, i.e. the energization period, to be determined.

The calculation rules for each iteration step are as follows:

Setpoint current configuration value for the current time step:

$$cur_step=cur_step+step_cur_1$$

Determination of the absolute current:

$$i_step=f(v_step,cur_step) \quad \text{(see equation (6))}$$

Determination of the piezo voltage which is set (simplified piezo model):

$$v_step=v_step+(i_step\cdot dt)/(q_stat/(v_stat-(R_piezo\cdot i_step)))$$

Determination of the charge which is set:

$$q_step=q_step+(i_step\cdot dt)$$

In this context the following applies:

i_step=absolute current state from the polynomial model [A]

v_step=voltage state [V]

cur_step=setpoint current state [%]

q_step=charge state [As]

step_cur_1=increment of the setpoint current in the case of rising functions [%]

dt=time increment [s]

q_stat=steady-state setpoint charge value (model input) [As]

v_stat=steady-state setpoint voltage value (model input) [V]

R_piezo=ohmic resistance of the piezo actuator [Ohm].

Figure 4:
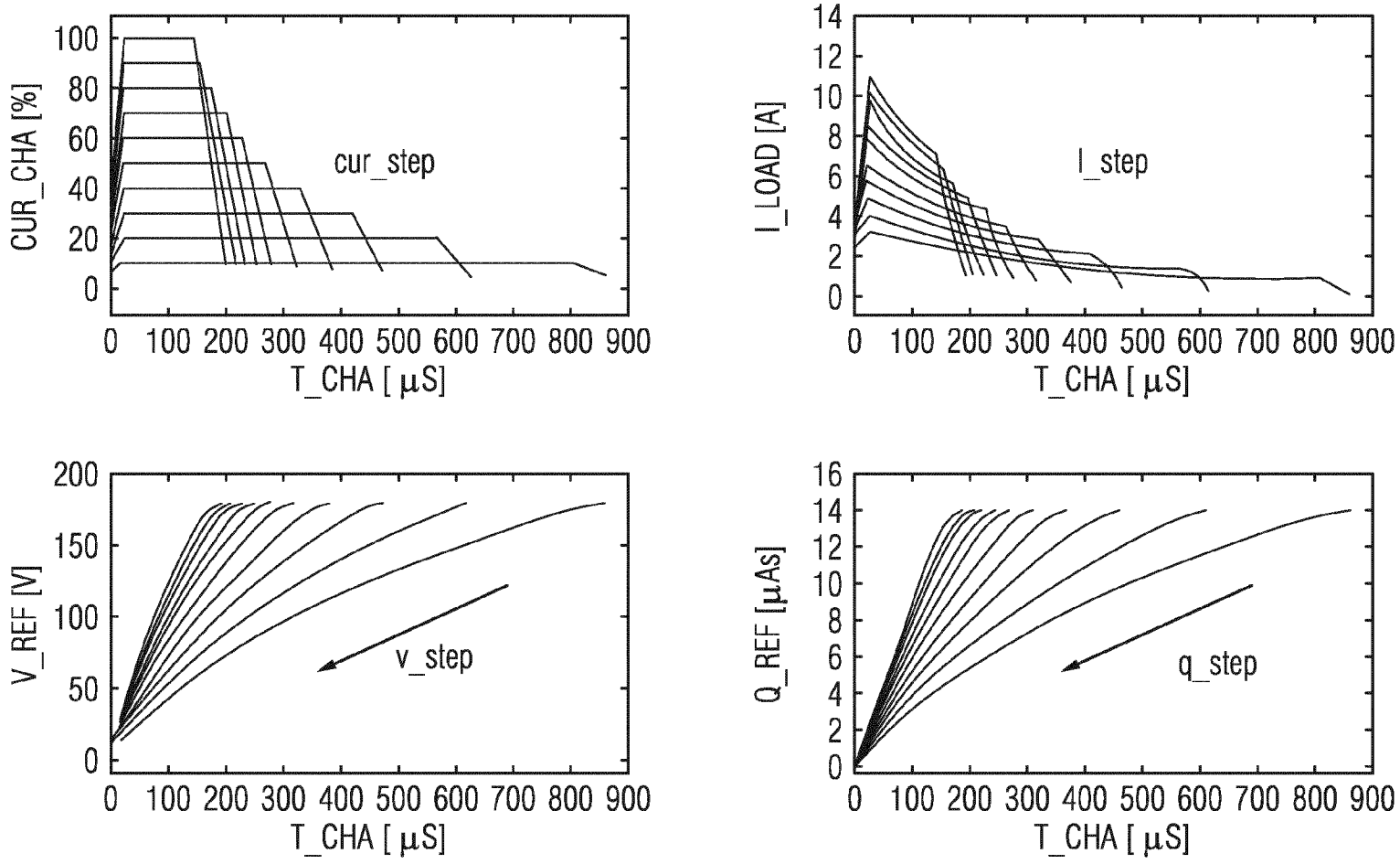
FIG. 4 shows diagrams illustrating the determination of the energization data incorporating teachings of the present disclosure.

FIG. 4 shows the calculated current profiles (I_LOAD/i_step), voltage profiles (V_REF/v_step) and charge profiles (Q_REF/q_step) in the case of a trapezoidal setpoint current prescription (CUR_CHA/cur_step) as a function of the charging time (T_CHA). The individual curves each correspond to a specific trapezoidal configuration composed of a rising current edge, holding phase and falling current edge. It becomes apparent that each configuration corresponds precisely to a charging time if the same final values for the voltage and charge are to be achieved.

Figure 5:
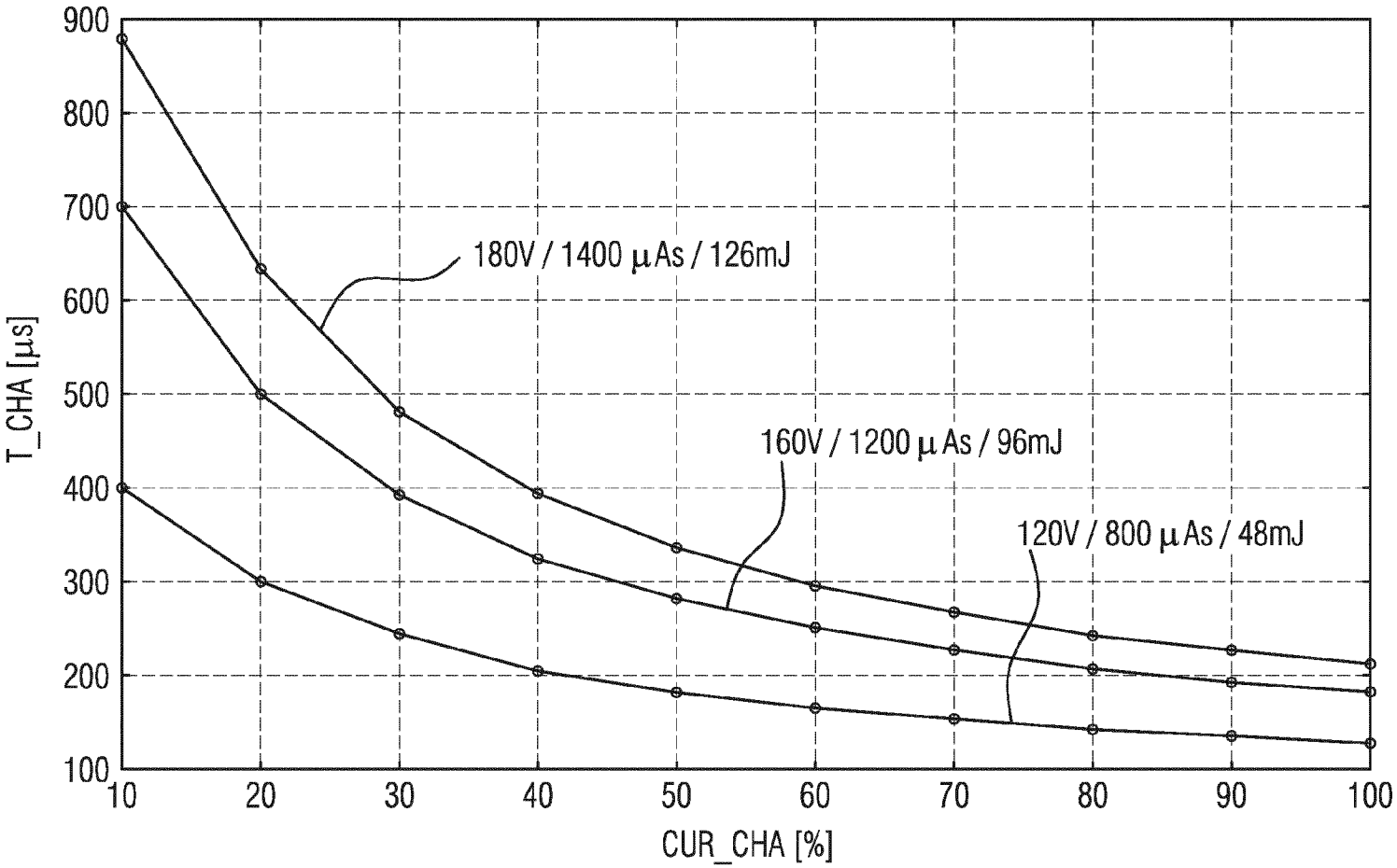
FIG. 5 shows a diagram illustrating the relationship between the calculated charging time and the setpoint current incorporating teachings of the present disclosure.

FIG. 5 shows a diagram illustrating the relationship between the calculated charging time T_CHA and the setpoint value CUR_CHA of the current at different setpoint values for the steady-state final voltage and/or discharge.

Figure 6:
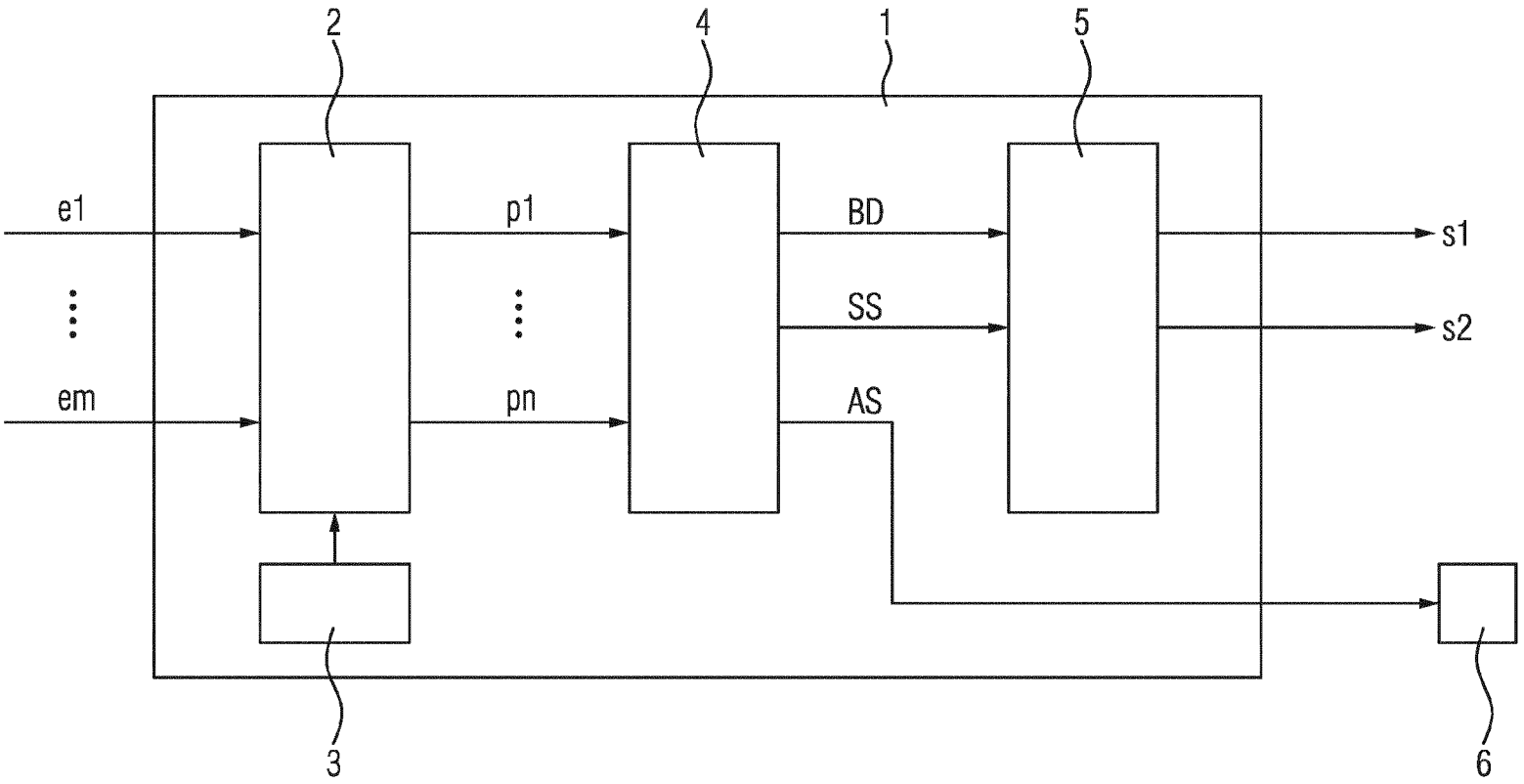
FIG. 6 shows a block illustration of a control unit incorporating teachings of the present disclosure.

FIG. 6 shows a block illustration of a control unit 1 which makes available the control signals s1 and s2 (shown in FIG. 1) for the transistors T1 and T2 of the buck-boost converter. This control unit 1 has a determining unit 2 which determines input parameters pl, . . . , pn for the regression model 4 from input signals el, . . . , em supplied to the control unit, using working programs and characteristic diagrams stored in a memory 3. The regression model 4, which is, as described above, a polynomial regression model which, in the exemplary embodiment shown above, carries out regression in the form of a two-dimensional polynomial with coefficients a to f, determines, from the input parameters supplied to it, energization data which preferably include an energization period BD and a setpoint current strength SS as percentages. Furthermore, the regression model 4 may also determine, from the input parameters supplied to it, an absolute current strength AS, specified as a percentage, which is supplied to an external controller 6.

The specified energization data BD and SS are supplied to a converter unit 5, which converts the determined energization data into the control signals s1 and s2 for the transistors T1 and T2. The input signals el, . . . , em of the control unit 1 are data which characterize or describe the instantaneous operating point of the injection system. These data, which are made available by sensors, by way of example include information about the fuel pressure in the rail of the internal combustion engine, information about the position of the accelerator pedal, information about the temperature of the fuel upstream of the fuel high-pressure pump and information about the temperature of the piezo actuator.

The input parameters pl, . . . , pn of the regression model 4 are, in particular, information about the desired piezo voltage and/or information about the desired piezo charge and information about the temperature of the piezo actuator. Furthermore, the input parameters of the regression model preferably also include information about the desired opening behavior of the injection valve, information about a desired oscillation behavior of the piezo actuator, information about system-specific parameters such as, for example, the internal resistance of the piezo actuator and information about possible tolerances of the piezo actuator as well as information about further boundary conditions of the injection system, for example information about a maximum time window which is available for the energization.

A method for determining the energization data of an electromechanical transducer has been described above. This method can alternatively also be used to determine the energization data of an electromagnetic transducer, such as is used, for example, in solenoid injectors.

What is claimed is:

1. A method for operating an actuator of an injection valve of a motor vehicle, the method comprising:

receiving input data at a control unit, the input data including at least one datum selected from the group consisting of: a rail pressure, a position of an accelerator pedal, a temperature of a fuel upstream of a high-pressure pump, and a temperature of the actuator; and determining resulting energization data based on the received input data with the control unit;

wherein determining the resulting energization data includes using a polynomial regression model to determine an energization period, a setpoint current strength, and an absolute current strength;

wherein the polynomial regression accounts for at least one parameters selected from the group consisting of: a desired actuator voltage, a desired actuator charge, a desired opening behavior of the injection valve, a desired oscillation behavior of the injection valve, an internal resistance of the actuator, and a maximum time window available for energization of the actuator; and adjusting a current input to the actuator based on the energization data and a desired charging time.

2. The method as claimed in claim 1, wherein the control unit determines the energization data as a function of an operating point.

3. The method as claimed in claim 1, further comprising determining an energization period with the control unit.

4. The method as claimed in claim 3, further comprising determining a current profile with the control unit.

5. The method as claimed in claim 4, further comprising determining a current strength at predefined times of the energization period with the control unit.

6. The method as claimed in claim 1, wherein the input data includes information about a desired piezo voltage.

7. The method as claimed in claim 1, wherein the input data includes information about a desired piezo charge.

8. The method as claimed in claim 1, wherein the input data includes information about a desired behavior of the actuator.

9. The method as claimed in claim 1, wherein the input data includes information about a desired oscillation behavior of the actuator.

10. The method as claimed in claim 1, wherein the input data includes temperature information.

11. The method as claimed in claim 1, wherein the input data includes information about one or more individual parameters of the actuator.

12. The method as claimed in claim 1, wherein the input data includes information about a maximum available energization time window.

13. The method as claimed in claim 1, wherein the actuator comprises an electromechanical or an electromagnetic transducer.

14. The method as claimed in claim 1, wherein the actuator comprises a piezo actuator.

15. A control unit for an actuator of an injection valve in a motor vehicle, the control unit comprising:

a processor with access to a memory; and a data feed receiving input data;

wherein the memory stores instructions for execution by the processor for determining resulting energization data for the actuator based on the input data using a polynomial regression model, wherein the resulting energization data includes an energization period, a setpoint current strength, and an absolute current strength; and the processor is programmed to adjust a current input to the actuator based on the energization data and a desired charging time;

wherein the input data includes at least one datum selected from the group consisting of: a rail pressure, a position of an accelerator pedal, a temperature of a fuel upstream of a high-pressure pump, and a temperature of the actuator; and wherein the polynomial regression accounts for at least one parameters selected from the group consisting of: a desired actuator voltage, a desired actuator charge, a desired opening behavior of the injection valve, a desired oscillation behavior of the injection valve, an internal resistance of the actuator, and a maximum time window available for energization of the actuator.

* * * * *